US011503411B2

(12) United States Patent
Devantier

(10) Patent No.: US 11,503,411 B2
(45) Date of Patent: Nov. 15, 2022

(54) ULTRA SLIM TRANSDUCER

(71) Applicant: Samsung Electronics Co., Ltd., Suwon-si (KR)

(72) Inventor: Allan Devantier, Newhall, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 27 days.

(21) Appl. No.: 16/936,875

(22) Filed: Jul. 23, 2020

(65) Prior Publication Data

US 2022/0030358 A1 Jan. 27, 2022

(51) Int. Cl.

| | |
|---|---|
| ***H04R 9/06*** | (2006.01) |
| ***H04R 9/02*** | (2006.01) |
| ***H04R 9/04*** | (2006.01) |
| ***H04R 7/04*** | (2006.01) |
| ***H04R 1/02*** | (2006.01) |

(52) U.S. Cl.

CPC ..... *H04R 9/06* (2013.01); *H04R 1/02* (2013.01); *H04R 7/04* (2013.01); *H04R 9/025* (2013.01); *H04R 9/046* (2013.01)

(58) Field of Classification Search

CPC ... H04R 9/06; H04R 1/02; H04R 7/04; H04R 9/025; H04R 9/046

See application file for complete search history.

(56) References Cited

U.S. PATENT DOCUMENTS

2012/0263336 A1* 10/2012 Stead ..... H01F 7/0289 381/396
2013/0228393 A1* 9/2013 Sterling ..... H04R 1/34 181/150
2020/0100032 A1* 3/2020 Gomes ..... H04R 1/028

FOREIGN PATENT DOCUMENTS

JP 2007158643 A * 6/2007

* cited by examiner

*Primary Examiner* — Tuan D Nguyen
(74) *Attorney, Agent, or Firm* — Sherman IP LLP; Kenneth L. Sherman; Steven Laut

(57) ABSTRACT

One embodiment provides a slim acoustic transducer with a diaphragm that is substantially centered on a vertical axis. A first top plate is substantially perpendicular to the vertical axis. The first top plate houses a first upper magnet. A first bottom plate is substantially perpendicular to the vertical axis. The first bottom plate houses a first lower magnet. A voice coil has a height parallel to the vertical axis. The voice coil is at least partially disposed within the first top plate and at least partially disposed within the first bottom plate.

19 Claims, 8 Drawing Sheets

700

810

800

1200

1310

1300

1700

1810

1800

ULTRA SLIM TRANSDUCER

COPYRIGHT DISCLAIMER

A portion of the disclosure of this patent document may contain material that is subject to copyright protection. The copyright owner has no objection to the facsimile reproduction by anyone of the patent document or the patent disclosure as it appears in the patent and trademark office patent file or records, but otherwise reserves all copyright rights whatsoever.

TECHNICAL FIELD

One or more embodiments relate generally to transducers, and in particular, to a slim acoustic transducer with side-mounted voice-coils that are perpendicular to a diaphragm.

BACKGROUND

Televisions, laptops, and phones are becoming thinner, but there is still demand for better sound quality (e.g., more bass output). In order to produce low frequency sound (e.g., bass), a loudspeaker has to move a lot of air which can be achieved either by a large surface area or large excursion of the diaphragm. A high surface area of shallow transducers is prone to bending and rocking, which introduces distortion and other mechanical problems.

Often it is not possible to have the diaphragm exposed. Instead, the sound has to radiate through a narrow slot, which increases the overall built height (thickness) of the acoustic module. Advantages of slot loading the transducer include preventing it from being touched and also minimizing interference with industrial design. Slot loading a shallow transducer, however, also makes it more prone to rocking because the acoustic load on the diaphragm becomes asymmetric.

SUMMARY

One embodiment provides a slim acoustic transducer with a diaphragm that is substantially centered on a vertical axis. A first top plate is substantially perpendicular to the vertical axis. The first top plate houses a first upper magnet. A first bottom plate is substantially perpendicular to the vertical axis. The first bottom plate houses a first lower magnet. A voice coil has a height parallel to the vertical axis. The voice coil is at least partially disposed within the first top plate and at least partially disposed within the first bottom plate.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to transducers, and in particular, to a slim acoustic transducer with side-mounted voice-coils that are perpendicular to a diaphragm. One embodiment provides a slim acoustic transducer with a diaphragm that is substantially centered on a vertical axis. A first top plate is substantially perpendicular to the vertical axis. The first top plate houses a first upper magnet. A first bottom plate is substantially perpendicular to the vertical axis. The first bottom plate houses a first lower magnet. A voice coil has a height parallel to the vertical axis. The voice coil is at least partially disposed within the first top plate and at least partially disposed within the first bottom plate.

For expository purposes, the terms "loudspeaker," "loudspeaker device," and "loudspeaker system" may be used interchangeably in this specification.

For expository purposes, a diaphragm is a membrane attached to a voice coil, which moves in a magnetic gap, vibrating the diaphragm, and producing sound.

Figure 1:
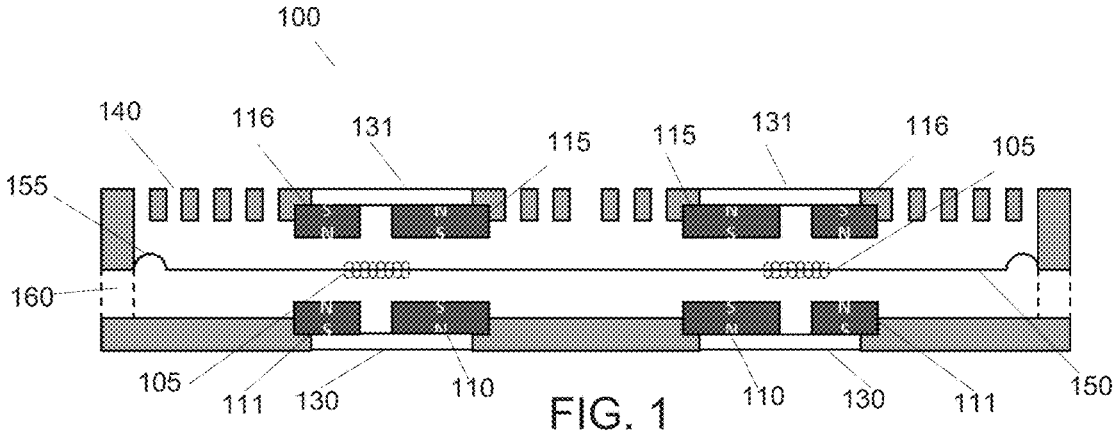
FIG. 1 (Prior Art)
FIG. 1 illustrates a cross-sectional view of a conventional planar-magnetic micro-speaker.

FIG. 1 illustrates a cross-sectional view of a conventional planar magnetic micro-speaker 100. The micro-speaker 100 includes a first magnet pair 110 and 115, a second magnet pair 111 and 116, a bottom plate (or frame) 130, a top plate (or frame) 131, a grill (or cover) 140, a diaphragm 150 with a surround 155, and voice coil 105. The magnetic flux is formed between the first magnet pair 110 and 115 and the second magnet pair 111 and 116, and the voice coil 105. The micro-speaker 100 has a vent(s) (or opening(s)) 160 that form a direct radiating type of speaker for direct radiation of sound. The voice coil 105 of the micro-speaker 100 moves with the diaphragm 150 between the first magnet pair 110 and 115 and the second magnet pair 111 and 116 upon receiving a sound signal (e.g., from an audio receiver, music player, television audio signal, etc.). The bottom plate 130 and top plate 131 may be made of low carbon steel, soft magnetic steel, or similar material. The first magnet pair 110 and 115 and the second magnet pair 111 and 116 may be comprised of rare earth magnetic material, such as: Neodymium (Nd), Nd Iron Boron (NdFeB), Samarium Cobalt, etc. The structure material surrounding the micro-speaker 100 may be plastic, aluminum, etc.

Figure 2:
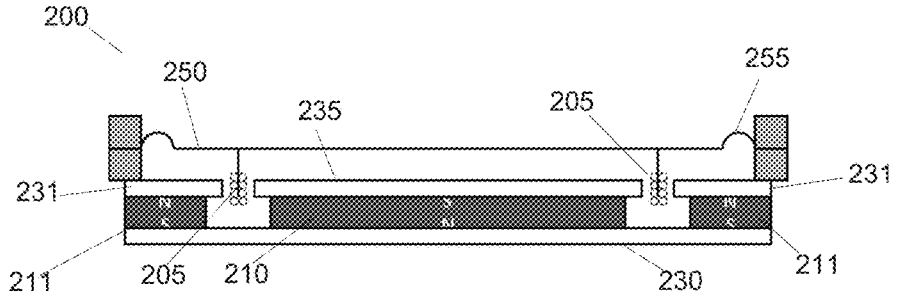
FIG. 2 (Prior Art)
FIG. 2 illustrates a cross-sectional view of an example conventional micro-speaker.

FIG. 2 illustrates a cross-sectional view of an example conventional micro-speaker 200. Micro-speaker 200 includes a first magnet 210, a second magnet 211, voice coil 205, a diaphragm 250 with a surround 255, a base plate 230, and top plate portions 231 and 235. The voice coil 205 of the micro-speaker 200 moves with the diaphragm 250 between the gap between the top plate portions 231 and 235 upon receiving a sound signal (e.g., from an audio receiver, music player, television audio signal, etc.).

Figure 3:
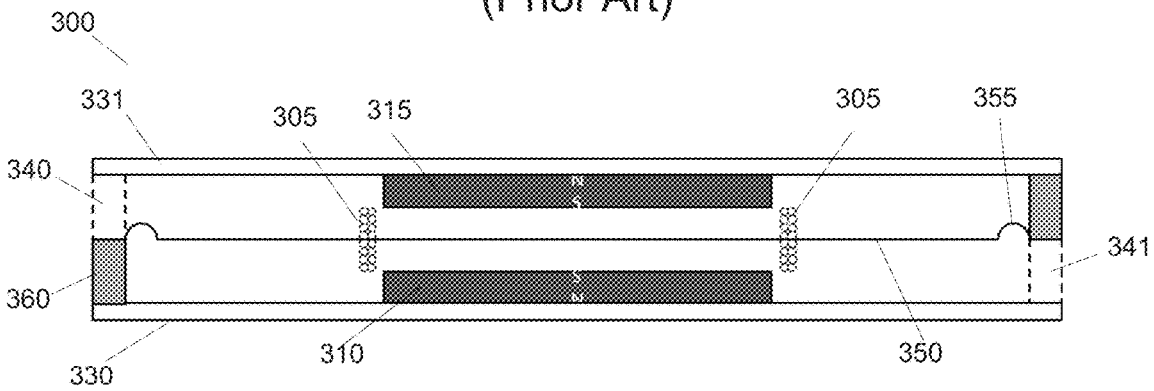
FIG. 3 illustrates a cross-sectional view of an ultra-slim transducer, according to some embodiments.

FIG. 3 illustrates a cross-sectional view of an ultra-slim transducer 300, according to some embodiments. In some embodiments, the ultra-slim transducer 300 includes a magnet system including a lower (or bottom) magnet 310, (e.g., ring-shaped, circular-shaped, cylindrical shaped, oval shaped, polygonal shaped, etc.), an upper (or top) magnet 315 (e.g., ring-shaped, circular-shaped, cylindrical shaped, oval shaped, polygonal shaped, etc.), a diaphragm 350 with suspension 355 (e.g., a torus, etc.), a voice coil 305 (e.g., ring-shaped, circular-shaped, oval-shaped, polygonal shaped, etc.), a bottom (or lower) plate 330 and top (or upper) plate 331, and structure 360 (e.g., low carbon steel, soft magnetic steel, plastic, aluminum, etc.). In some embodiments, the lower magnet 310 and the upper magnet 315 may be comprised of rare earth magnetic material, such as: Nd, NdFeB, Samarium Cobalt, etc. In some embodiments, the lower magnet 310 and the upper magnet 315 have opposing polarity to increase the magnetic flux.

In some embodiments, the bottom plate 330 and the top plate 331 may each be made of low carbon steel, soft magnetic steel, or similar material. In some embodiments, the diaphragm 350 may be made of paper, polypropylene (PP), polyetheretherketone (PEEK) polycarbonate (PC), Polyethylene Terephthalate (PET), silk, glass fiber, carbon fiber, titanium, aluminum, aluminum-magnesium alloy, nickel, beryllium, etc.

In some embodiments, the diaphragm 350 is centered (or substantially close to centered) on a vertical axis. The top plate 331 is perpendicular (or substantially close to perpendicular) to the vertical axis. In some embodiments, the top plate 331 houses the upper magnet 315. The bottom plate 330 is perpendicular (or substantially close to perpendicular) to the vertical axis, and houses the lower magnet 310. In one or more embodiments, the voice coil 305 has a height that is parallel to the vertical axis, and is at least partially disposed within the top plate 331 and at least partially disposed within the bottom plate 330. The voice coil 305 of the micro-speaker 300 moves with the diaphragm 350 upon receiving a sound signal (e.g., from an audio receiver, music player, television audio signal, etc.).

In some embodiments, the ultra-slim transducer 300 may be implemented for a woofer, a midrange, a tweeter and full-range transducers. The ultra-slim transducer 300 can be made small enough to be built into cell phones, for example 4 mm×10 mm×15 mm. The ultra-slim transducer 300 can also be made large enough to be used as a sub-woofer transducer, for example with a 300 mm diameter or larger. In some embodiments, the ultra-slim transducer 300 may be implemented as a stand-alone unit or in devices and micro-electronic equipment, such as mobile phones, camcorders, personal digital assistants (PDAs), digital cameras, notebook computers, televisions (TVs), digital video disc players (DVDs), etc.

Figure 4:
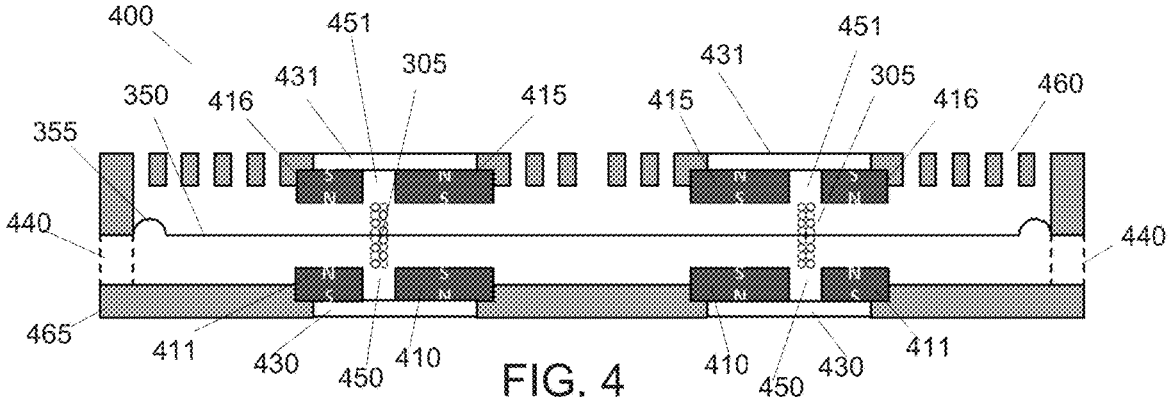
FIG. 4 illustrates a cross-sectional view of a direct radiating ultra-slim transducer with two magnet pairs, according to some embodiments.

FIG. 4 illustrates a cross-sectional view of a direct radiating ultra-slim transducer 400 with two magnet pairs, according to some embodiments. In some embodiments, the ultra-slim transducer 400 includes a two magnet pair system having a lower (or bottom) first magnet 410 (e.g., ring-shaped, circular-shaped, cylindrical shaped, oval shaped, polygonal shaped, etc.), an upper (or top) first magnet 415 (e.g., ring-shaped, circular-shaped, cylindrical shaped, oval shaped, polygonal shaped, etc.), a lower (or bottom) second magnet 411 (e.g., ring-shaped, circular-shaped, cylindrical shaped, oval shaped, polygonal shaped, etc.), an upper (or top) second magnet 416 (e.g., ring-shaped, circular-shaped, cylindrical shaped, oval shaped, polygonal shaped, etc.), a diaphragm 350 with suspension 355, a voice coil 305 (e.g., ring-shaped, circular-shaped, oval-shaped, polygonal shaped, etc.), a bottom (or lower) plate 430 (e.g., ring-shaped, circular-shaped, oval-shaped, polygonal shaped, etc.), a top (or upper) plate 431 (e.g., ring-shaped, circular-shaped, oval-shaped, polygonal shaped, etc.), grill structure 460 (e.g., low carbon steel, soft magnetic steel, plastic, aluminum, etc.), and structure 465 (e.g., low carbon steel, soft magnetic steel, plastic, aluminum, etc.). In some embodiments, the lower first magnet 410, the upper first magnet 415, the lower first magnet 411 and the upper second magnet 416 may each be comprised of rare earth magnetic material, such as: Nd, NdFeB, Samarium Cobalt, etc. In some embodiments, the bottom plate 430 and the top plate 431 may each be made of low carbon steel, soft magnetic steel, or similar material.

In some embodiments, the diaphragm 350 is centered (or substantially close to centered) on a vertical axis. The top plate 431 is perpendicular (or substantially close to perpendicular) to the vertical axis. In some embodiments, the top plate 431 houses the upper first magnet 415 and the upper second magnet 416. The bottom plate 430 is perpendicular (or substantially close to perpendicular) to the vertical axis, and houses the lower first magnet 410 and the lower second magnet 411. In one or more embodiments, the voice coil 305 has a height that is parallel to the vertical axis, and is at least partially disposed within the top plate 431 and at least partially disposed within the bottom plate 430. The voice coil 305 of the ultra-slim transducer 400 moves with the diaphragm 350 between the gap 451 between the upper first magnet 415 and the upper second magnet 416, and between the gap 450 between the lower first magnet 410 and the lower second magnet 411 upon receiving a sound signal (e.g., from an audio receiver, music player, television audio signal, etc.). In some embodiments, the slot or venting of grill structure 460 radiates sound waves into the listening environment (e.g., a room, etc.). In some embodiments, the slot or venting 440 may be implemented for venting sound waves to the internal speaker volume.

In some embodiments, the ultra-slim transducer 400 may be implemented for a woofer, a midrange, a tweeter and full-range transducers. The ultra-slim transducer 400 can be made small enough to be built into cell phones, for example 4 mm×10 mm×15 mm. The ultra-slim transducer 400 can also be made large enough to be used as a sub-woofer transducer, for example with a 300 mm diameter or larger. In some embodiments, the ultra-slim transducer 400 may be implemented as a stand-alone unit or in devices and micro-electronic equipment, such as mobile phones, camcorders, PDAs, digital cameras, notebook computers, TVs, DVDs, etc.

Figure 5:
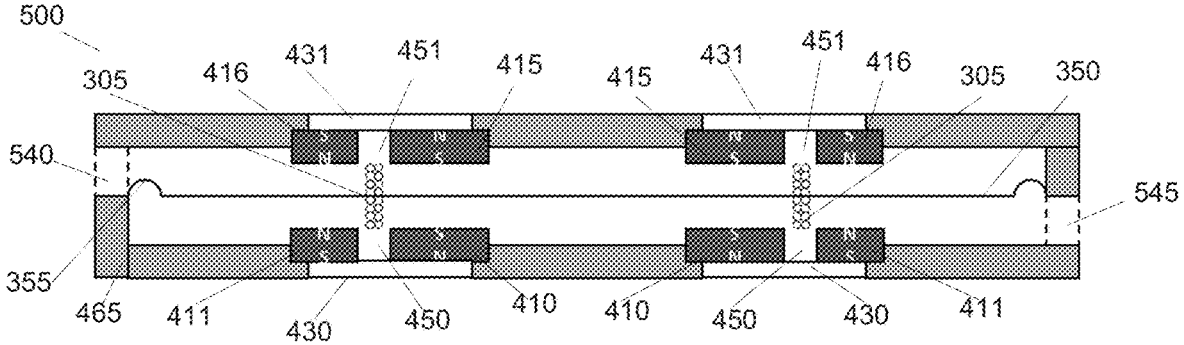
FIG. 5 illustrates a cross-sectional view of a slot firing ultra-slim transducer with two magnet pairs, according to some embodiments.

FIG. 5 illustrates a cross-sectional view of a slot firing ultra-slim transducer 500 with two magnet pairs, according to some embodiments. In some embodiments, the ultra-slim transducer 500 includes a two magnet pair system having a lower (or bottom) first magnet 410, an upper (or top) first magnet 415, a lower (or bottom) second magnet 411, an upper (or top) second magnet 416, a diaphragm 350 with suspension 355, a voice coil 305, a bottom (or lower) plate 430 and top (or upper) plate 431, and structure 465.

In some embodiments, the diaphragm 350 is centered (or substantially close to centered) on a vertical axis. The top plate 431 is perpendicular (or substantially close to perpendicular) to the vertical axis. In some embodiments, the top plate 431 houses the upper first magnet 415 and the upper second magnet 416. The bottom plate 430 is perpendicular (or substantially close to perpendicular) to the vertical axis, and houses the lower first magnet 410 and the lower second magnet 411. In one or more embodiments, the voice coil 305 has a height that is parallel to the vertical axis, and is at least partially disposed within the top plate 431 and at least partially disposed within the bottom plate 430. The voice coil 305 of the micro-speaker 500 moves with the diaphragm 350 between the gap 451 between the upper first magnet 415 and the upper second magnet 416, and between the gap 450 between the lower first magnet 410 and the lower second magnet 411 upon receiving a sound signal (e.g., from an audio receiver, music player, television audio signal, etc.). In some embodiments, the slots or venting 540 and 545 radiate sound waves into the listening environment (e.g., a room, etc.). In some embodiments, the slot or venting 540 and 545 may be implemented for venting sound waves to the internal speaker volume.

In some embodiments, the ultra-slim transducer 500 may be implemented for a woofer, a midrange, a tweeter and full-range transducers. The ultra-slim transducer 500 can be made small enough to be built into cell phones, for example 4 mm×10 mm×15 mm. The ultra-slim transducer 500 can also be made large enough to be used as a sub-woofer transducer, for example with a 300 mm diameter or larger. In some embodiments, the ultra-slim transducer 500 may be implemented as a stand-alone unit or in devices and micro-electronic equipment, such as mobile phones, camcorders, PDAs, digital cameras, notebook computers, TVs, DVDs, etc.

Figure 6:
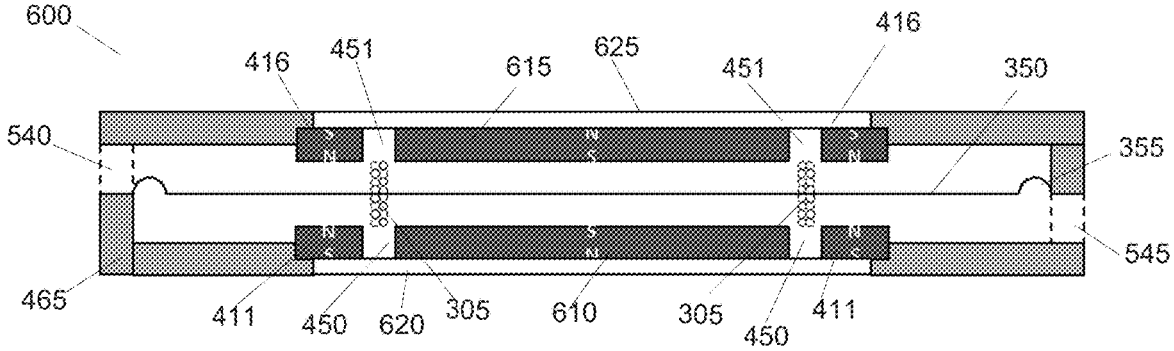
FIG. 6 illustrates a cross-sectional view of a slot firing ultra-slim transducer with two magnet pairs, according to some embodiments.

FIG. 6 illustrates a cross-sectional view of a slot firing ultra-slim transducer 600 with two magnet pairs, according to some embodiments. In some embodiments, the ultra-slim transducer 600 includes a two magnet pair system having a lower (or bottom) first magnet 610 (e.g., ring-shaped, circular-shaped, cylindrical shaped, oval shaped, polygonal shaped, etc.), an upper (or top) first magnet 615 (e.g., ring-shaped, circular-shaped, cylindrical shaped, oval shaped, polygonal shaped, etc.), a lower (or bottom) second magnet 411, an upper (or top) second magnet 416, a diaphragm 350 with suspension 355, a voice coil 305, a bottom (or lower) plate 620 and top (or upper) plate 625, and structure 465.

In some embodiments, the diaphragm 350 is centered (or substantially close to centered) on a vertical axis. The top plate 625 is perpendicular (or substantially close to perpendicular) to the vertical axis. In some embodiments, the top plate 625 houses the upper first magnet 415 and the upper second magnet 416. The bottom plate 620 is perpendicular (or substantially close to perpendicular) to the vertical axis, and houses the lower first magnet 410 and the lower second magnet 411. In one or more embodiments, the voice coil 305 has a height that is parallel to the vertical axis, and is at least partially disposed within the top plate 625 and at least partially disposed within the bottom plate 620. The voice coil 305 of the micro-speaker 600 moves with the diaphragm 350 between the gap 451 between the upper first magnet 615 and the upper second magnet 416, and between the gap 450 between the lower first magnet 610 and the lower second magnet 411 upon receiving a sound signal (e.g., from an audio receiver, music player, television audio signal, etc.). In some embodiments, the slots or venting 540 and 545 radiates sound waves into the listening environment (e.g., a room, etc.). In some embodiments, the slot or venting 540 and 545 may be implemented for venting sound waves to the internal speaker volume.

In some embodiments, the ultra-slim transducer 600 may be implemented for a woofer, a midrange, a tweeter and full-range transducers. The ultra-slim transducer 600 can be made small enough to be built into cell phones, for example 4 mm×10 mm×15 mm. The ultra-slim transducer 600 can also be made large enough to be used as a sub-woofer transducer, for example with a 300 mm diameter or larger. In some embodiments, the ultra-slim transducer 600 may be implemented as a stand-alone unit or in devices and micro-electronic equipment, such as mobile phones, camcorders, PDAs, digital cameras, notebook computers, TVs, DVDs, etc.

Figure 7:
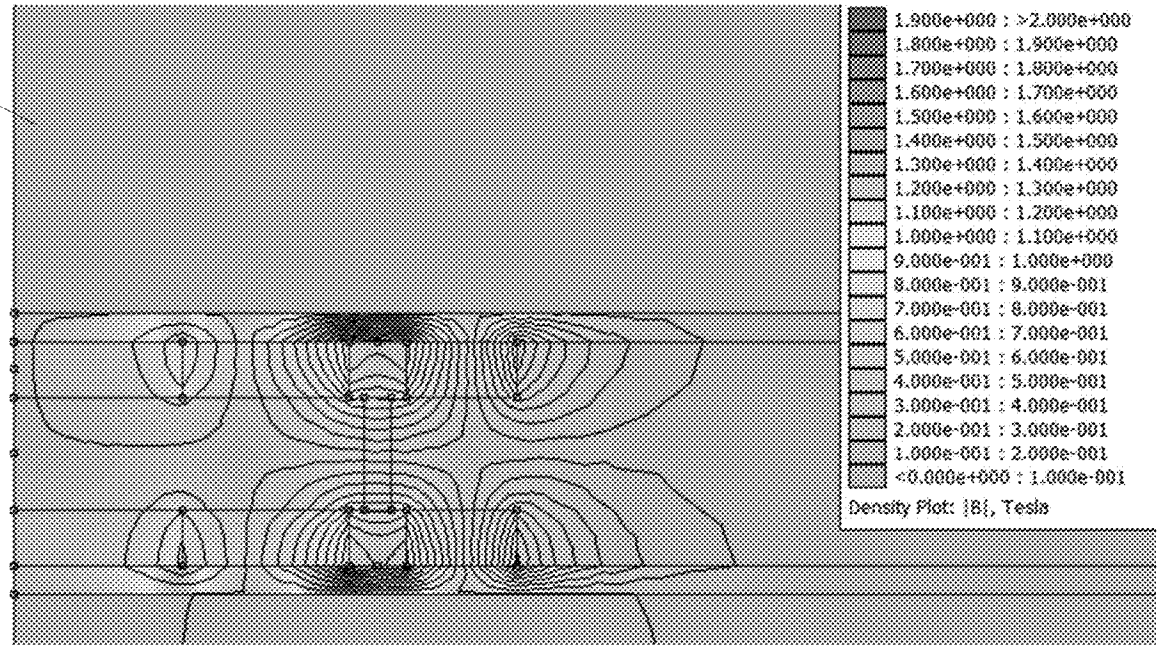
FIG. 7 illustrates an image of magnetic flux for the ultra-slim transducer of FIG. 6, according to some embodiments.

FIG. 7 illustrates an image 700 of magnetic flux for the ultra-slim transducer 600 of FIG. 6, according to some embodiments. For the image 700, the magnetic flux curves show the flux generated by the lower (or bottom) first magnet 610, the upper (or top) first magnet 615, the lower (or bottom) second magnet 411 and the upper (or top) second magnet 416. For the image 700, the lower (or bottom) first magnet 610, the upper (or top) first magnet 615, the lower (or bottom) second magnet 411 and the upper (or top) second magnet 416 are 52 Mega Gauss-Oersteds (MGOe).

Figure 8B:
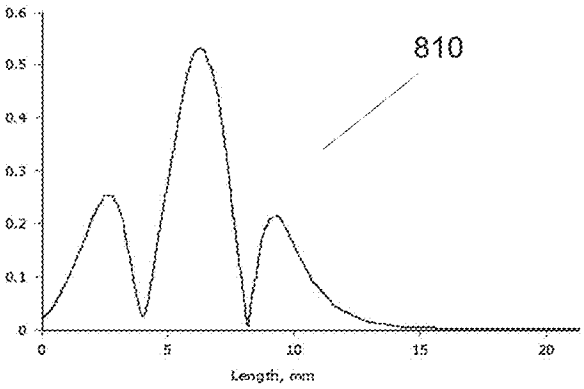
FIG. 8B illustrates a graph of flux through a speaker structure middle radially for the ultra-slim transducer of FIG. 6, according to some embodiments.
Figure 8A:
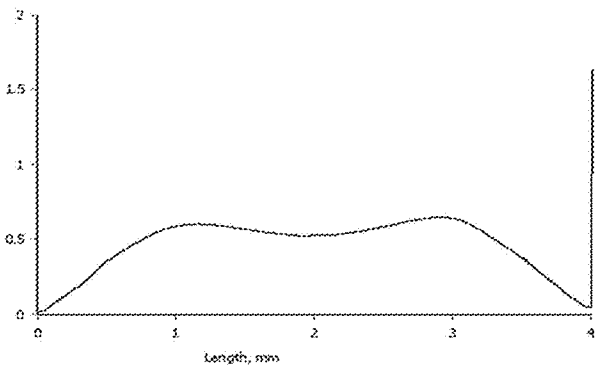
FIG. 8A illustrates a graph of flux through a magnetic coil and speaker structure for the ultra-slim transducer of FIG. 6, according to some embodiments.

FIG. 8A illustrates a graph 800 of flux through the magnetic coil 305 and speaker structure (bottom (or lower) plate 620 and top (or upper) plate 625, and structure 465) for the ultra-slim transducer 600 of FIG. 6, according to some embodiments.

FIG. 8B illustrates a graph 810 of flux through the speaker structure (bottom (or lower) plate 620 and top (or upper) plate 625, and structure 465) middle radially for the ultra-slim transducer 600 of FIG. 6, according to some embodiments.

Figure 9:
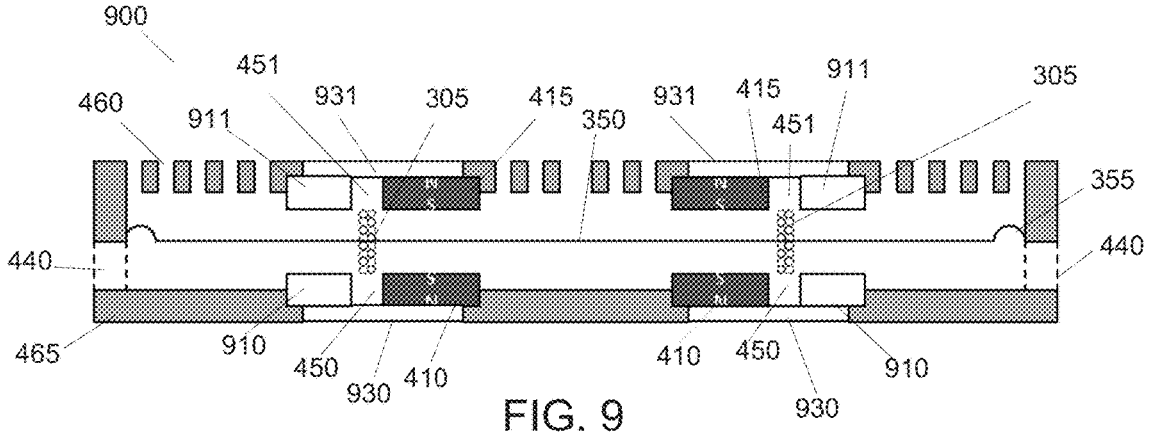
FIG. 9 illustrates a cross-sectional view of a direct radiating ultra-slim transducer with one magnet pair, according to some embodiments.

FIG. 9 illustrates a cross-sectional view of a direct radiating ultra-slim transducer 900 with one magnet pair, according to some embodiments. In some embodiments, the ultra-slim transducer 900 includes a one magnet pair system having a lower (or bottom) first magnet 410, an upper (or top) first magnet 415, a diaphragm 350 with suspension 355, a voice coil 305, a bottom (or lower) plate 930 (e.g., ring-shaped, circular-shaped, oval-shaped, polygonal shaped, etc.), top (or upper) plate 931 (e.g., ring-shaped, circular-shaped, oval-shaped, polygonal shaped, etc.), a lower metallic structure 910 (e.g., ring-shaped, circular-shaped, oval-shaped, polygonal shaped, etc.), an upper metallic structure 911 (e.g., ring-shaped, circular-shaped, oval-shaped, polygonal shaped, etc.), and structure 465. In some embodiments, the bottom plate 930, the top plate 931, the lower metallic structure 910 and the upper metallic structure 911 may each be made of low carbon steel, soft magnetic steel, or similar material.

In some embodiments, the diaphragm 350 is centered (or substantially close to centered) on a vertical axis. The top plate 931 is perpendicular (or substantially close to perpendicular) to the vertical axis. In some embodiments, the top plate 931 houses the upper first magnet 415 and the upper metallic structure 911. The bottom plate 930 is perpendicular (or substantially close to perpendicular) to the vertical axis, and houses the lower first magnet 410 and the lower metallic structure 910. In one or more embodiments, the voice coil 305 has a height that is parallel to the vertical axis, and is at least partially disposed within the top plate 931 and at least partially disposed within the bottom plate 930. The voice coil 305 of the micro-speaker 900 moves with the diaphragm 350 between the gap 451 between the upper first magnet 415 and the upper metallic structure 911, and between the gap 450 between the lower first magnet 410 and the lower metallic structure 910 upon receiving a sound signal (e.g., from an audio receiver, music player, television audio signal, etc.). In some embodiments, the slots or venting 440 radiate sound waves into the listening environment (e.g., a room, etc.). In some embodiments, the slot or venting 440 may be implemented for venting sound waves to the internal speaker volume.

In some embodiments, the ultra-slim transducer 900 may be implemented for a woofer, a midrange, a tweeter and full-range transducers. The ultra-slim transducer 900 can be made small enough to be built into cell phones, for example 4 mm×10 mm×15 mm. The ultra-slim transducer 900 can also be made large enough to be used as a sub-woofer transducer, for example with a 300 mm diameter or larger. In some embodiments, the ultra-slim transducer 900 may be implemented as a stand-alone unit or in devices and microelectronic equipment, such as mobile phones, camcorders, PDAs, digital cameras, notebook computers, TVs, DVDs, etc.

Figure 10:
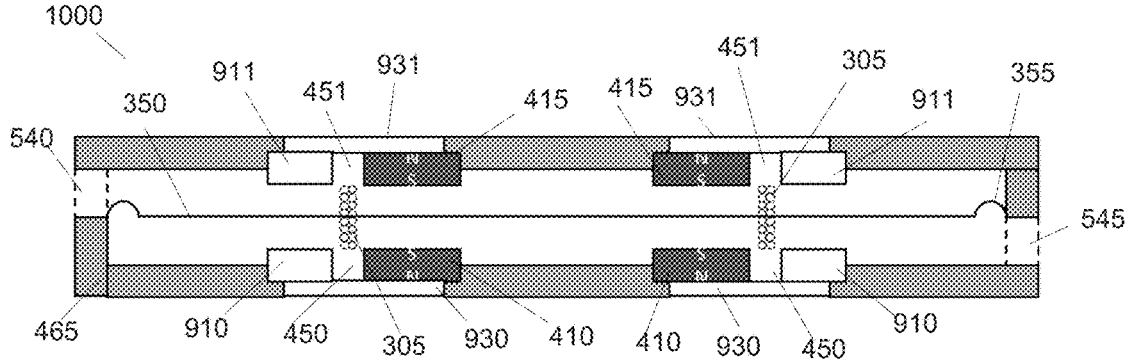
FIG. 10 illustrates a cross-sectional view of a slot firing ultra-slim transducer with one magnet pair, according to some embodiments.

FIG. 10 illustrates a cross-sectional view of a slot firing ultra-slim transducer 1000 with one magnet pair, according to some embodiments. In some embodiments, the ultra-slim transducer 1000 includes a one magnet pair system having a lower (or bottom) first magnet 410, an upper (or top) first magnet 415, a diaphragm 350 with suspension 355, a voice coil 305, a bottom (or lower) plate 930, top (or upper) plate 931, a lower metallic structure 910, an upper metallic structure 911, and structure 465.

In some embodiments, the diaphragm 350 is centered (or substantially close to centered) on a vertical axis. The top plate 931 is perpendicular (or substantially close to perpendicular) to the vertical axis. In some embodiments, the top plate 931 houses the upper first magnet 415 and the upper metallic structure 911. The bottom plate 930 is perpendicular (or substantially close to perpendicular) to the vertical axis, and houses the lower first magnet 410 and the lower metallic structure 910. In one or more embodiments, the voice coil 305 has a height that is parallel to the vertical axis, and is at least partially disposed within the top plate 931 and at least partially disposed within the bottom plate 930. The voice coil 305 of the micro-speaker 1000 moves with the diaphragm 350 between the gap 451 between the upper first magnet 415 and the upper metallic structure 911, and between the gap 450 between the lower first magnet 410 and the lower metallic structure 910 upon receiving a sound signal (e.g., from an audio receiver, music player, television audio signal, etc.). In some embodiments, the slots or venting 540 radiate sound waves into the listening environment (e.g., a room, etc.). In some embodiments, the slot or venting 540 may be implemented for venting sound waves to the internal speaker volume.

In some embodiments, the ultra-slim transducer 1000 may be implemented for a woofer, a midrange, a tweeter and full-range transducers. The ultra-slim transducer 1000 can be made small enough to be built into cell phones, for example 4 mm×10 mm×15 mm. The ultra-slim transducer 1000 can also be made large enough to be used as a sub-woofer transducer, for example with a 300 mm diameter or larger. In some embodiments, the ultra-slim transducer 1000 may be implemented as a stand-alone unit or in devices and microelectronic equipment, such as mobile phones, camcorders, PDAs, digital cameras, notebook computers, TVs, DVDs, etc.

Figure 11:
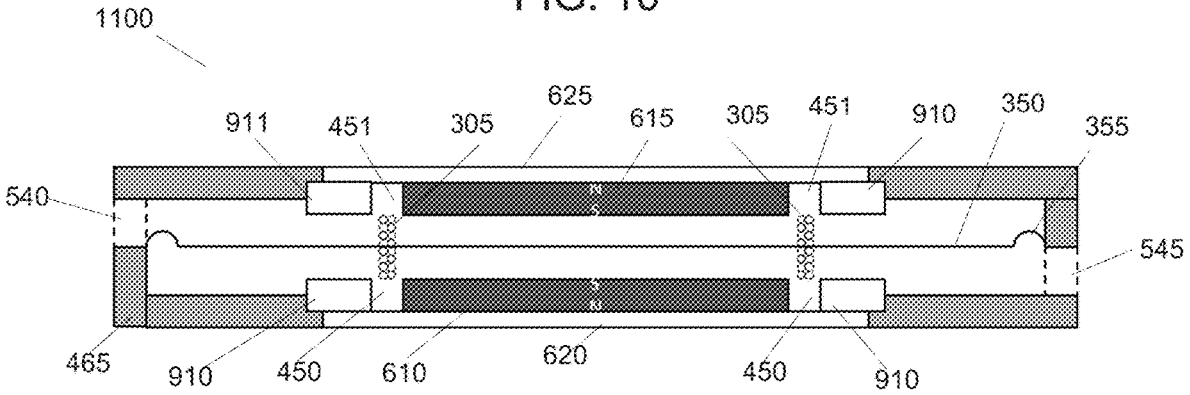
FIG. 11 illustrates a cross-sectional view of a slot firing ultra-slim transducer with one disc magnet pair, according to some embodiments.

FIG. 11 illustrates a cross-sectional view of a slot firing ultra-slim transducer 1100 with one disc magnet pair, according to some embodiments. In some embodiments, the ultra-slim transducer 1100 includes a lower (or bottom) first magnet 610, an upper (or top) first magnet 615, a diaphragm 350 with suspension 355, a voice coil 305, a bottom (or lower) plate 620, a top (or upper) plate 625, a lower metallic structure 910, an upper metallic structure 911, and structure 465.

In some embodiments, the diaphragm 350 is centered (or substantially close to centered) on a vertical axis. The top plate 625 is perpendicular (or substantially close to perpendicular) to the vertical axis. In some embodiments, the top plate 625 houses the upper first magnet 615 and the upper metallic structure 911. The bottom plate 620 is perpendicular (or substantially close to perpendicular) to the vertical axis, and houses the lower first magnet 610 and the lower metallic structure 910. In one or more embodiments, the voice coil 305 has a height that is parallel to the vertical axis, and is at least partially disposed within the top plate 625 and at least partially disposed within the bottom plate 620. The voice coil 305 of the micro-speaker 1100 moves with the diaphragm 350 between the gap 451 between the upper first magnet 615 and the upper metallic structure 911, and between the gap 450 between the lower first magnet 610 and the lower metallic structure 910 upon receiving a sound signal (e.g., from an audio receiver, music player, television audio signal, etc.). In some embodiments, the slots or venting 540 and 545 radiates sound waves into the listening environment (e.g., a room, etc.). In some embodiments, the slot or venting 540 and 545 may be implemented for venting sound waves to the internal speaker volume.

In some embodiments, the ultra-slim transducer 1100 may be implemented for a woofer, a midrange, a tweeter and full-range transducers. The ultra-slim transducer 1100 can be made small enough to be built into cell phones, for example 4 mm×10 mm×15 mm. The ultra-slim transducer 1100 can also be made large enough to be used as a sub-woofer transducer, for example with a 300 mm diameter or larger. In some embodiments, the ultra-slim transducer 1100 may be implemented as a stand-alone unit or in devices and microelectronic equipment, such as mobile phones, camcorders, PDAs, digital cameras, notebook computers, TVs, DVDs, etc.

Figure 12:
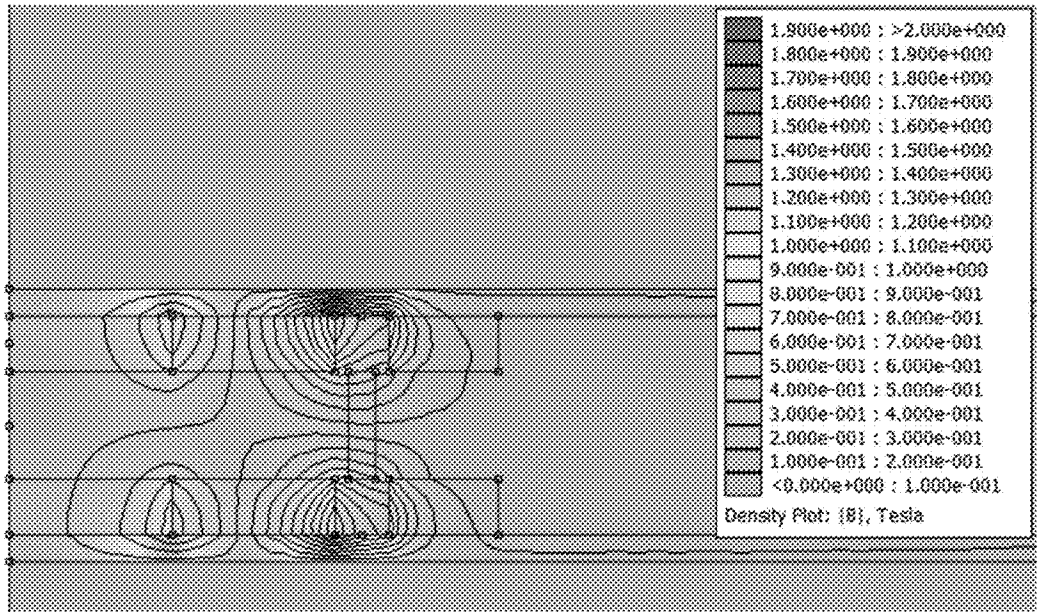
FIG. 12 illustrates an image of magnetic flux for the ultra-slim transducer of FIG. 11, according to some embodiments.

FIG. 12 illustrates an image 1200 of magnetic flux for the ultra-slim transducer 1100 of FIG. 11, according to some embodiments. For the image 1200, the magnetic flux curves show the flux generated by the lower (or bottom) first magnet 610, the upper (or top) first magnet 615, the lower metallic structure 910 and the upper metallic structure 911. For the image 1200, the lower (or bottom) first magnet 610 and the upper (or top) first magnet 615 are 52 MGOe.

Figure 13B:
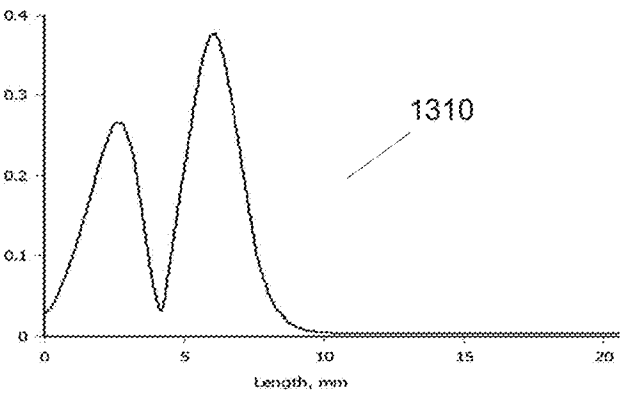
FIG. 13B illustrates a graph of flux through a speaker structure middle radially for the ultra-slim transducer of FIG. 11, according to some embodiments.
Figure 13A:
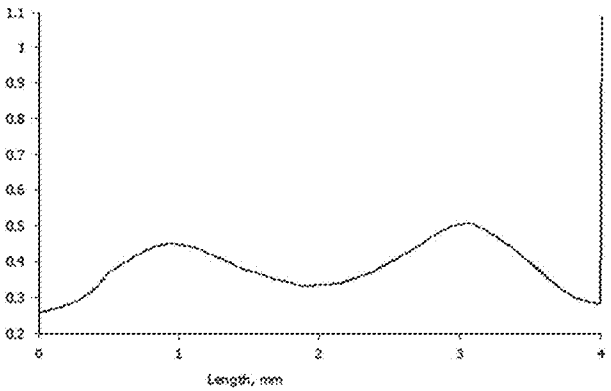
FIG. 13A illustrates a graph of flux through a magnetic coil and speaker structure for the ultra-slim transducer of FIG. 11, according to some embodiments.

FIG. 13A illustrates a graph 1300 of flux through the magnetic coil 305 and speaker structure (bottom (or lower) plate 620 and top (or upper) plate 625, the lower metallic structure 910, the upper metallic structure 911, and the structure 465) for the ultra-slim transducer 1100 of FIG. 11, according to some embodiments.

FIG. 13B illustrates a graph 1310 of flux through the speaker structure (bottom (or lower) plate 620 and top (or upper) plate 625, the lower metallic structure 910, the upper metallic structure 911, and the structure 465) middle radially for the ultra-slim transducer 1100 of FIG. 11, according to some embodiments.

Figure 14:
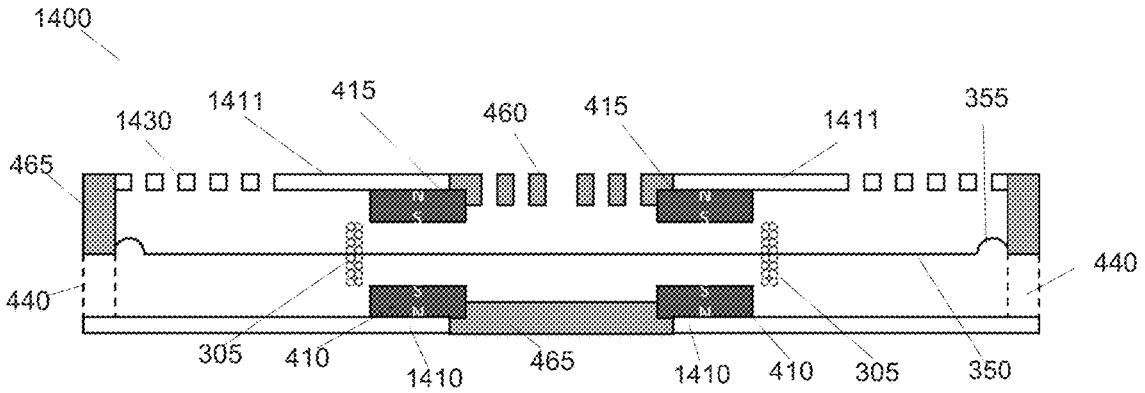
FIG. 14 illustrates a cross-sectional view of another direct radiating ultra-slim transducer, according to some embodiments.

FIG. 14 illustrates a cross-sectional view of another direct radiating ultra-slim transducer 1400, according to some embodiments. In some embodiments, the ultra-slim transducer 1400 includes a two magnet pair system having a lower (or bottom) first magnet 410, an upper (or top) first magnet 415, a diaphragm 350 with suspension 355, a voice coil 305, a bottom (or lower) plate 1410 (e.g., ring-shaped, circular-shaped, oval-shaped, polygonal shaped, etc.), a top (or upper) plate 1411 (e.g., ring-shaped, circular-shaped, oval-shaped, polygonal shaped, etc.), grill structure 460 and metallic grill structure 1430 and structure 465. In some embodiments, the bottom plate 1410, the top plate 1411 and the metallic grill structure 1430 may each be made of low carbon steel, soft magnetic steel, or similar material.

In some embodiments, the diaphragm 350 is centered (or substantially close to centered) on a vertical axis. The top plate 1411 is perpendicular (or substantially close to perpendicular) to the vertical axis. In some embodiments, the top plate 1411 houses the upper first magnet 415. The bottom plate 1410 is perpendicular (or substantially close to perpendicular) to the vertical axis, and houses the lower first magnet 410. In one or more embodiments, the voice coil 305 has a height that is parallel to the vertical axis, and is at least partially disposed within the top plate 1411 and at least partially disposed within the bottom plate 1410. The voice coil 305 of the micro-speaker 1400 moves with the diaphragm 350 between the upper first magnet 415 and the lower first magnet 410 upon receiving a sound signal (e.g., from an audio receiver, music player, television audio signal, etc.). In some embodiments, the slot or venting of the grill structure 460 radiates sound waves into the listening environment (e.g., a room, etc.). In some embodiments, the slot or venting 440 may be implemented for venting sound waves to the internal speaker volume.

In some embodiments, the ultra-slim transducer 1400 may be implemented for a woofer, a midrange, a tweeter and full-range transducers. The ultra-slim transducer 1400 can be made small enough to be built into cell phones, for example 4 mm×10 mm×15 mm. The ultra-slim transducer 1400 can also be made large enough to be used as a sub-woofer transducer, for example with a 300 mm diameter or larger. In some embodiments, the ultra-slim transducer 1400 may be implemented as a stand-alone unit or in devices and microelectronic equipment, such as mobile phones, camcorders, PDAs, digital cameras, notebook computers, TVs, DVDs, etc.

Figure 15:
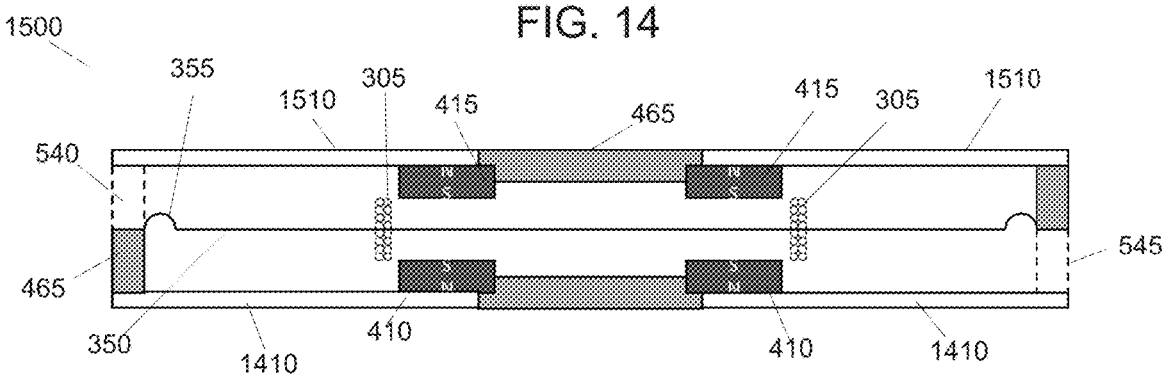
FIG. 15 illustrates a cross-sectional view of another slot firing ultra-slim transducer, according to some embodiments.

FIG. 15 illustrates a cross-sectional view of another slot firing ultra-slim transducer 1500, according to some embodiments. In some embodiments, the ultra-slim transducer 1500 includes a two magnet pair system having a lower (or bottom) first magnet 410, an upper (or top) first magnet 415, a diaphragm 350 with suspension 355, a voice coil 305, a bottom (or lower) plate 1410 (e.g., ring-shaped, circular-shaped, oval-shaped, polygonal shaped, etc.), a top (or upper) plate 1510 (e.g., ring-shaped, circular-shaped, oval-shaped, polygonal shaped, etc.), and structure 465. In some embodiments, the top plate 1510 may be made of low carbon steel, soft magnetic steel, or similar material.

In some embodiments, the diaphragm 350 is centered (or substantially close to centered) on a vertical axis. The top plate 1510 is perpendicular (or substantially close to perpendicular) to the vertical axis. In some embodiments, the top plate 1510 houses the upper first magnet 415. The bottom plate 1410 is perpendicular (or substantially close to perpendicular) to the vertical axis, and houses the lower first magnet 410. In one or more embodiments, the voice coil 305 has a height that is parallel to the vertical axis, and is at least partially disposed within the top plate 1510 and at least partially disposed within the bottom plate 1410. The voice coil 305 of the micro-speaker 1500 moves with the diaphragm 350 between the upper first magnet 415 and the lower first magnet 410 upon receiving a sound signal (e.g., from an audio receiver, music player, television audio signal, etc.). In some embodiments, the slot or venting 540 and 545 radiates sound waves into the listening environment (e.g., a room, etc.). In some embodiments, the slot or venting 540 and 545 may be implemented for venting sound waves to the internal speaker volume.

In some embodiments, the ultra-slim transducer 1500 may be implemented for a woofer, a midrange, a tweeter and full-range transducers. The ultra-slim transducer 1500 can be made small enough to be built into cell phones, for example 4 mm×10 mm×15 mm. The ultra-slim transducer 1500 can also be made large enough to be used as a sub-woofer transducer, for example with a 300 mm diameter or larger. In some embodiments, the ultra-slim transducer 1500 may be implemented as a stand-alone unit or in devices and microelectronic equipment, such as mobile phones, camcorders, PDAs, digital cameras, notebook computers, TVs, DVDs, etc.

Figure 16:
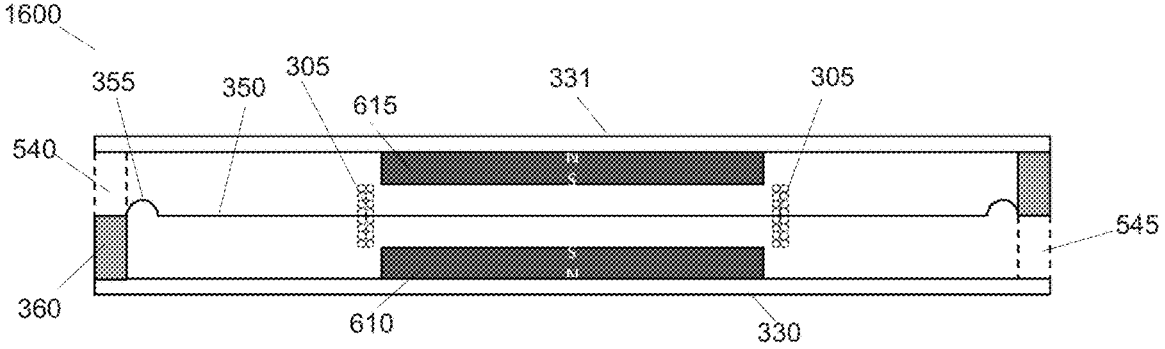
FIG. 16 illustrates a cross-sectional view of yet another slot firing ultra-slim transducer, according to some embodiments.

FIG. 16 illustrates a cross-sectional view of yet another slot firing ultra-slim transducer 1600, according to some embodiments. In some embodiments, the ultra-slim transducer 1600 includes a magnet system including a lower (or bottom) magnet 610, an upper (or top) magnet 615, a diaphragm 350 with suspension 355, a voice coil 305, a bottom (or lower) plate 330, a top (or upper) plate 331, and structure 360.

In some embodiments, the diaphragm 350 is centered (or substantially close to centered) on a vertical axis. The top plate 331 is perpendicular (or substantially close to perpendicular) to the vertical axis. In some embodiments, the top plate 331 houses the upper magnet 615. The bottom plate 330 is perpendicular (or substantially close to perpendicular) to the vertical axis, and houses the lower magnet 610. In one or more embodiments, the voice coil 305 has a height that is parallel to the vertical axis, and is at least partially disposed within the top plate 331 and at least partially disposed within the bottom plate 330. The voice coil 305 of the micro-speaker 1600 moves with the diaphragm 350 upon receiving a sound signal (e.g., from an audio receiver, music player, television audio signal, etc.). In some embodiments, the slots or venting 540 and 545 radiates sound waves into the listening environment (e.g., a room, etc.). In some embodiments, the slot or venting 540 and 545 may be implemented for venting sound waves to the internal speaker volume.

In some embodiments, the ultra-slim transducer 1600 may be implemented for a woofer, a midrange, a tweeter and full-range transducers. The ultra-slim transducer 1600 can be made small enough to be built into cell phones, for example 4 mm×10 mm×15 mm. The ultra-slim transducer 1600 can also be made large enough to be used as a sub-woofer transducer, for example with a 300 mm diameter or larger. In some embodiments, the ultra-slim transducer 1600 may be implemented as a stand-alone unit or in devices and microelectronic equipment, such as mobile phones, camcorders, PDAs, digital cameras, notebook computers, TVs, DVDs, etc.

Figure 17:
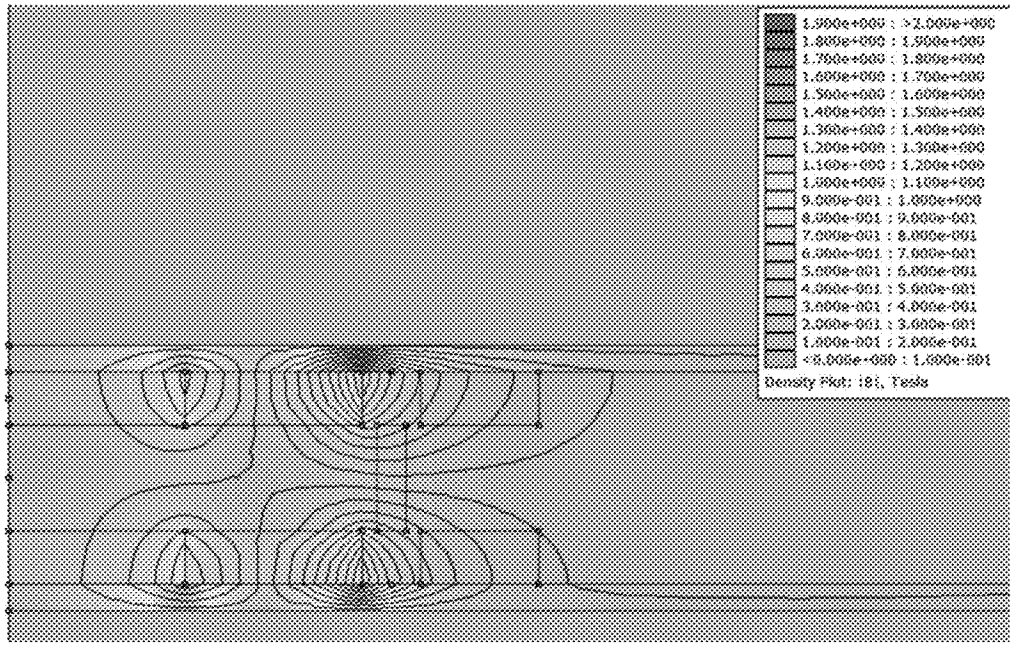
FIG. 17 illustrates an image of magnetic flux for the ultra-slim transducer of FIG. 16, according to some embodiments.

FIG. 17 illustrates an image 1700 of magnetic flux for the ultra-slim transducer 1600 of FIG. 16, according to some embodiments. For the image 1700, the magnetic flux curves show the flux generated by the lower (or bottom) first magnet 610 and the upper (or top) first magnet 615. For the image 1700, the lower (or bottom) first magnet 610 and the upper (or top) first magnet 615 are 52 MGOe.

Figure 18B:
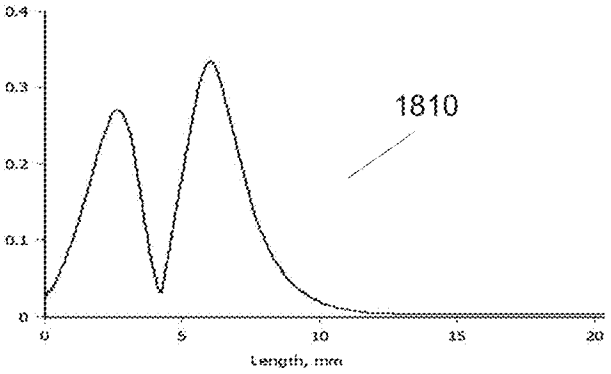
FIG. 18B illustrates a graph of flux through a speaker structure middle radially for the ultra-slim transducer of FIG. 16, according to some embodiments.
Figure 18A:
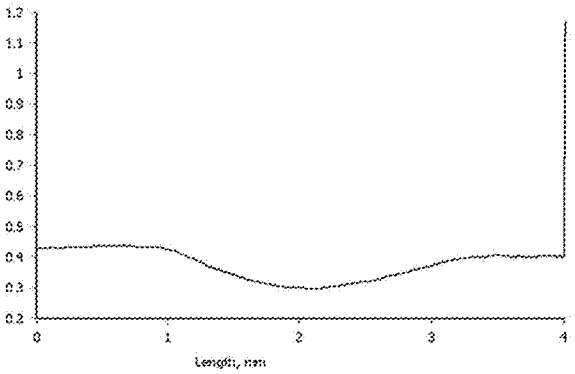
FIG. 18A illustrates a graph of flux through a magnetic coil and speaker structure for the ultra-slim transducer of FIG. 16, according to some embodiments.

FIG. 18A illustrates a graph 1800 of flux through the magnetic coil 305 and speaker structure (bottom (or lower) plate 330, top (or upper) plate 331, and the structure 360) for the ultra-slim transducer 1600 of FIG. 16, according to some embodiments.

FIG. 18B illustrates a graph 1810 of flux through a speaker structure (bottom (or lower) plate 330, top (or upper) plate 331, and the structure 360) middle radially for the ultra-slim transducer 1600 of FIG. 16, according to some embodiments.

Figure 19:
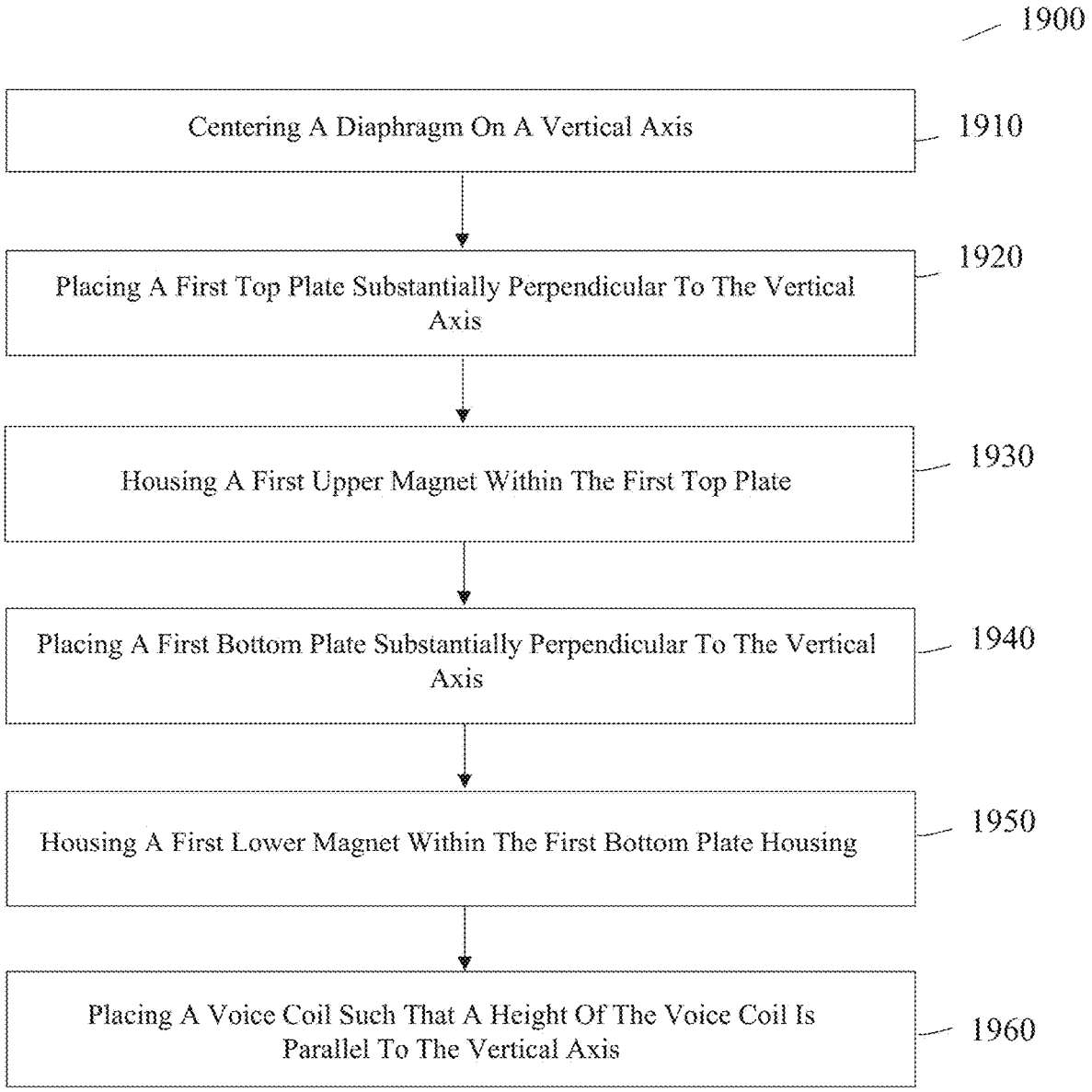
FIG. 19 illustrates a process for designing a slim acoustic transducer, according to some embodiments.

FIG. 19 illustrates a process 1900 for designing a slim acoustic transducer, according to some embodiments. In some embodiments, in block 1910 the process 1900 provides for centering a diaphragm (e.g., diaphragm 350, FIGS. 3-6, 9-11 and 14-16) on a vertical axis. In block 1920 the process 1900 provides for placing a first top plate (e.g., top plate 331, FIGS. 3 and 16, top plate 431, FIG. 4, top late 625, FIGS. 6 and 11, top plate 931, FIGS. 9 and 10, top plate 1411, FIGS. 5 and 14 or top plate 1510, FIG. 15) substantially perpendicular to the vertical axis. In block 1930 the process 1900 provides for housing a first upper magnet (e.g., upper magnet 315, FIG. 3, first magnet 415 or second magnet 416, FIGS. 4, 5, 9, 10, 14, 15, upper first magnet 615, FIGS. 6, 11, 16) within the first top plate. In block 1940 the process 1900 provides for placing a first bottom plate (e.g., bottom plate 330, FIGS. 3 and 16, bottom plate 430, FIGS. 4 and 5, bottom plate 620, FIGS. 6 and 11, bottom plate 930, FIGS. 9 and 10, bottom plate 1410, FIGS. 14 and 15) substantially perpendicular to the vertical axis. In block 1950 the process 1900 provides for housing a first lower magnet (e.g., lower magnet 310, FIG. 3, first magnet 410 or second magnet 411, FIGS. 4, 5, 6, 9, 10, 14, 15, lower first magnet 610, FIGS. 6, 11, 16) within the first bottom plate. In block 1960 the process 1900 provides for placing a voice coil (e.g., voice coil 305, FIGS. 3-6, 9-11 and 14-16) such that a height of the voice coil is parallel to the vertical axis. In some embodiments, placing the voice coil includes at least partially disposing the voice coil within the first top plate and at least partially disposing the voice coil within the first bottom plate.

In one embodiment, the process 1900 may be performed by using a robotic manufacturing system for the designing, various known manufacturing techniques, etc. The elements/components for designing the slim acoustic transducer may be similar to the elements/components of FIGS. 3-6, 9-11 and 14-16, as described above).

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A slim acoustic transducer comprising:

a diaphragm substantially centered on a vertical axis;

a first top plate substantially perpendicular to the vertical axis, the first top plate housing a first upper magnet;

a first bottom plate substantially perpendicular to the vertical axis, the first bottom plate housing a first lower magnet, wherein the first upper magnet is disposed over the first lower magnet; and a voice coil having a height parallel to the vertical axis, wherein the voice coil is at least partially disposed within the first top plate and at least partially disposed within the first bottom plate, the voice coil has a ring shape, the voice coil is disposed externally to an outer perimeter of each of the first upper magnet and the first lower magnet, and an upper portion of the voice coil and a lower portion of the voice coil are each disposed between the first upper magnet and the first lower magnet.

2. The transducer of claim 1, wherein each of the first upper magnet and the first lower magnet has a ring shape, the first upper magnet and the first lower magnet each have a same diameter, and the upper portion of the voice coil is disposed beneath a bottom portion of the first upper magnet.

3. The transducer of claim 1, further comprising a housing for the transducer, wherein the housing is configured as one of a direct radiating structure or a slot firing structure.

4. The transducer of claim 3, further comprising:

a first carbon steel portion adjacent the first upper magnet; and a second carbon steel portion adjacent the first lower magnet, wherein a first slot exists between the first carbon steel portion and the first upper magnet, a second slot exists between the second carbon steel portion and the first lower magnet, and the voice coil travels at least partially within the first slot and the second slot.

5. The transducer of claim 1, further comprising:

a second upper magnet housed in a second top plate; and a second lower magnet housed in a second bottom plate;

wherein the voice coil is at least partially disposed within the second top plate and at least partially disposed within the second bottom plate.

6. The transducer of claim 5, wherein each of the second upper magnet and the second lower magnet has a ring shape.

7. The transducer of claim 5, wherein:

each of the first upper magnet and the first lower magnet has a combined ring and disc shape; and each of the second upper magnet and the second lower magnet has a combined ring and disc shape.

8. The transducer of claim 5, further comprising a housing for the transducer, wherein the housing is configured as one of a direct radiating structure or a slot firing structure.

9. The transducer of claim 8, further comprising:

a first carbon steel portion adjacent the first upper magnet and the second upper magnet;

a second carbon steel portion adjacent the first lower magnet and the second lower magnet, wherein a first slot exists between the first carbon steel portion, the first upper magnet and the second upper magnet, a second slot exists between the second carbon steel portion, the first lower magnet and the second lower magnet, and the voice coil travels at least partially within the first slot and the second slot.

10. A slim acoustic transducer comprising:

a diaphragm substantially centered on a vertical axis;

a first top plate substantially perpendicular to the vertical axis, the first top plate coupled with a first upper magnet;

a first bottom plate substantially perpendicular to the vertical axis, the first bottom plate coupled with a first lower magnet, wherein the first upper magnet is disposed over the first lower magnet; and a voice coil having a height parallel to the vertical axis, the voice coil has a ring shape, the voice coil is disposed externally to an outer perimeter of each of the first upper magnet and the first lower magnet, and an upper portion of the voice coil and a lower portion of the voice coil are each disposed between the first upper magnet and the first lower magnet.

11. The transducer of claim 10, wherein the voice coil is at least partially disposed within the first top plate and at least partially disposed within the first bottom plate, and the first upper magnet and the first lower magnet each have a same diameter.

12. The transducer of claim 10, wherein each of the first upper magnet and the first lower magnet has a ring shape, and the upper portion of the voice coil is disposed beneath a bottom portion of the first upper magnet.

13. The transducer of claim 10, further comprising a housing for the transducer, wherein the housing is configured as one of a direct radiating structure or a slot firing structure.

14. The transducer of claim 13, further comprising:

a first carbon steel portion adjacent the first upper magnet; and a second carbon steel portion adjacent the first lower magnet, wherein a first slot exists between the first carbon steel portion and the first upper magnet, a second slot exists between the second carbon steel portion and the first lower magnet, and the voice coil travels at least partially within the first slot and the second slot.

15. The transducer of claim 10, further comprising:

a second upper magnet coupled with a second top plate; and a second lower magnet coupled with a second bottom plate;

wherein the voice coil is at least partially disposed within the second top plate and at least partially disposed within the second bottom plate.

16. The transducer of claim 15, wherein each of the second upper magnet and the second lower magnet has a ring shape.

17. The transducer of claim 15, wherein:

each of the first upper magnet and the first lower magnet has a combined ring and disc shape; and each of the second upper magnet and the second lower magnet has a combined ring and disc shape.

18. The transducer of claim 15, further comprising a housing for the transducer, wherein the housing is configured as one of a direct radiating structure or a slot firing structure.

19. The transducer of claim 18, further comprising:

a first carbon steel portion adjacent the first upper magnet and the second upper magnet;

a second carbon steel portion adjacent the first lower magnet and the second lower magnet, wherein a first slot exists between the first carbon steel portion, the first upper magnet and the second upper magnet, a second slot exists between the second carbon steel portion, the first lower magnet and the second lower magnet, and the voice coil travels at least partially within the first slot and the second slot.

* * * * *